US006359997B2

(12) United States Patent
Geisenberger et al.

(10) Patent No.: US 6,359,997 B2
(45) **Date of Patent: *Mar. 19, 2002**

(54) LOUDSPEAKER HAVING RADIALLY MAGNETIZED MAGNETIC RING

(75) Inventors: Stefan Geisenberger, Straubing; Gerhard Krump, Schwarzach, both of (DE)

(73) Assignee: Harman Audio Electronic Systems GmbH, Straubing (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/843,987

(22) Filed: Apr. 17, 1997

(30) Foreign Application Priority Data

Apr. 26, 1996 (DE) ..... 196 16 794

(51) Int. Cl.[7] ..... H04R 11/02; H04R 9/06

(52) U.S. Cl. ..... 381/412; 381/420; 381/421; 381/401

(58) Field of Search ..... 381/396, 401, 381/405, 412, 411, 400, 420, 416, 421, 414, 159, 154, 155, 152, 158, 419, FOR 159

(56) References Cited

U.S. PATENT DOCUMENTS

| | | | | | |
|---|---|---|---|---|---|
| 3,665,352 | A | * | 5/1972 | Dietrich et al. | 381/412 |
| 3,763,334 | A | * | 10/1973 | Parker | 381/412 |
| 4,327,257 | A | * | 4/1982 | Schwartz | 381/412 |
| 4,582,163 | A | * | 4/1986 | Cathoor | 381/412 |
| 4,783,820 | A | * | 11/1988 | Lyngdorf et al. | 381/401 |
| 5,142,260 | A | * | 8/1992 | House | 381/420 |
| 5,321,762 | A | * | 6/1994 | Stuart | 381/412 |
| 5,664,024 | A | * | 9/1997 | Furuta et al. | 381/412 |
| 5,715,324 | A | * | 2/1998 | Tanabe et al. | 381/412 |
| 5,786,741 | A | * | 7/1998 | Leibzon | 381/412 |
| 5,809,157 | A | * | 9/1998 | Grumazescu | 381/420 |
| 5,894,263 | A | * | 4/1999 | Shim et al. | 381/412 |
| 5,909,499 | A | * | 6/1999 | Tanabe | 381/419 |

FOREIGN PATENT DOCUMENTS

| | | | | |
|---|---|---|---|---|
| DE | 4234069 | | 4/1994 | |
| JP | 3-38999 | * | 2/1991 | 381/412 |
| JP | 2-268598 | * | 11/1999 | 381/412 |
| JP | 3-177198 | * | 11/1999 | 381/412 |
| WO | 9303586 | | 2/1993 | |

* cited by examiner

*Primary Examiner*—Curtis Kuntz
*Assistant Examiner*—Rexford Barnie
(74) *Attorney, Agent, or Firm*—Ware, Fressola, Van Der Sluys & Adolphson LLP

(57) ABSTRACT

A loudspeaker (10) according to the invention is presented, which contains at least one radially magnetized permanent magnet (12), and whose receiving part is made of a paramagnetic or diamagnetic material. Such loudspeakers (10) can be constructed in a very simple and compact manner. With the further development of loudspeakers (10) able to utilize the stray flux from radially magnetized permanent magnets (12), it is possible to produce derivations with two diaphragms (13, 13') with identical reproduction frequencies, without great cost.

18 Claims, 4 Drawing Sheets

LOUDSPEAKER HAVING RADIALLY MAGNETIZED MAGNETIC RING

TECHNICAL FIELD

The invention concerns the construction of loudspeakers, particularly the construction of driving systems for such loudspeakers, and the reciprocal assignment of such loudspeakers.

BACKGROUND OF THE INVENTION

In the state of the art it is known to build driving systems for loudspeakers in such a way, that a permanent magnet is connected to so-called yoke or back-closing parts, where a ring gap is left in the yoke parts into which the voice coil, which is connected to the loudspeaker, can later dip. Such an arrangement containing a permanent magnet which is magnetized axially to the longitudinal axis of the magnet system is indicated in DE-A-4113017 for example. Magnet systems with two permanent magnets are indicated in the publications DE-A-4234069 and DE-A-4225156.

In addition to this, magnet systems are known which contain permanent magnets that are magnetized radially to the longitudinal axis of the magnet system. These permanent magnets are either made in one piece or comprise a series of linked permanent magnet segments. Such arrangements are known from WO 93/03586 for example. These arrangements also contain back-closing parts which conduct the magnetic flux provided by the permanent magnets, so that sufficient induction is available for the ring gap.

The expensive manufacture as well as the heavy weight and the large volume of such systems or loudspeakers are considered to be disadvantages. It is therefore the task of the invention to create a magnet system which avoids the disadvantages of the state of the art.

SUMMARY OF THE INVENTION

This task is fulfilled by the features of a loudspeaker with a magnet system comprising at least one permanent magnet, which is magnetized crosswise to the longitudinal axis of the magnet system and has receiving parts that support the permanent magnet, or are connected thereto, characterized in that the receiving parts are made exclusively of a material that has paramagnetic or diamagnetic properties.

The basic idea of the present invention is to utilize the stray flux produced by a radially magnetized permanent magnet to drive a voice coil. This makes it possible to build the receiving parts for the permanent magnet from a paramagnetic or diamagnetic material. The result is that a considerable space and weight reduction is obtained, since the geometric specifications for the back-closing parts, which according to the state of the art must be taken into consideration for conducting the magnetic flux inside of these parts, are insignificant according to the invention. The invention strongly simplifies the manufacture of magnet systems as well, because the operating steps which are necessary to link the otherwise customary back-closing parts according to the state of the art, are omitted. The receiving part of the invention only forms the rearward closure of the loudspeaker, or a support structure for the permanent magnet and the remaining loudspeaker components.

Since a cone loudspeaker usually has a basket which is connected to the magnet system, it is possible to manufacture one-piece units of the receiving part and loudspeaker basket in a very cost-effective manner because the receiving part of the invention has no function with regard to the magnetic flux, nor should it have any in view of the stray flux utilization.

Plastics, metal and metal alloys are suitable materials for manufacturing receiving parts or units comprising a receiving part and a loudspeaker basket. Using metal to manufacture receiving parts in the preceding sense has special advantages since these materials also provide good heat transfer in the driving system area.

A particularly effective use of the stray flux generated by the permanent magnet is provided when the magnet system is built with a loudspeaker having another voice coil which is located at a radial distance from the other jacket surface of the permanent magnet. In that case the stray flux generated by the permanent magnet is used by both coils to drive a diaphragm.

Two or more permanent magnets can be arranged with a reciprocal axial space in the direction of the longitudinal axis of the magnet system to increase the stray flux required to drive the diaphragm. In such a configuration each of these permanent magnets can be surrounded by a voice coil on its inner and/or outer jacket side. If additional voice coils are used to drive a diaphragm for example, it is necessary to link these voice coils rigidly with each other. The magnet system of the invention can also be modified so that for example all the coils arranged on an inner jacket surface of the permanent magnet can be used to drive one diaphragm, and all the coils arranged on the other jacket surface can be used to drive another diaphragm.

A loudspeaker can also be constructed so that each voice coil is arranged on a voice coil support, wherein the voice coil support is a common voice coil support for the two voice coils, wherein each voice coil support has a first end and a second end, and that the first end at least is connected to a diaphragm.

If the respective voice coil support is tube-shaped, and if the first end of this voice coil support is connected to a first diaphragm, and the second end of this voice coil support is connected to a second diaphragm, and if both diaphragms and their supports etc. are constructed identically, such an arrangement can be used as a dipole radiator, for example to produce a diffuse sound field for a Dolby sound reproduction. According to the state of the art such diffuse sound fields are produced when two identical but inversely poled loudspeakers with separate volumes are used. But the desired effects can only be achieved with such arrangements when both loudspeakers have reproduction characteristics that are identical to within 1 to 2 dB. If these conditions are not upheld, the respective sound event can be perceived as coming from the front or from the back. It can easily be seen that the identity of the reproduction characteristics can only be assured at a considerable production cost. However if the arrangement for producing a diffuse sound field is built in the manner described above, deviations which are provoked for example by production-caused diaphragm differences or unavoidable manufacturing differences during the loudspeaker assembly can be balanced or minimized by having the production-caused differences of all diaphragms etc. become effective in every operating condition through a mechanical coupling of both diaphragms.

BEST MODE FOR CARRYING OUT THE INVENTION

Figure 1:
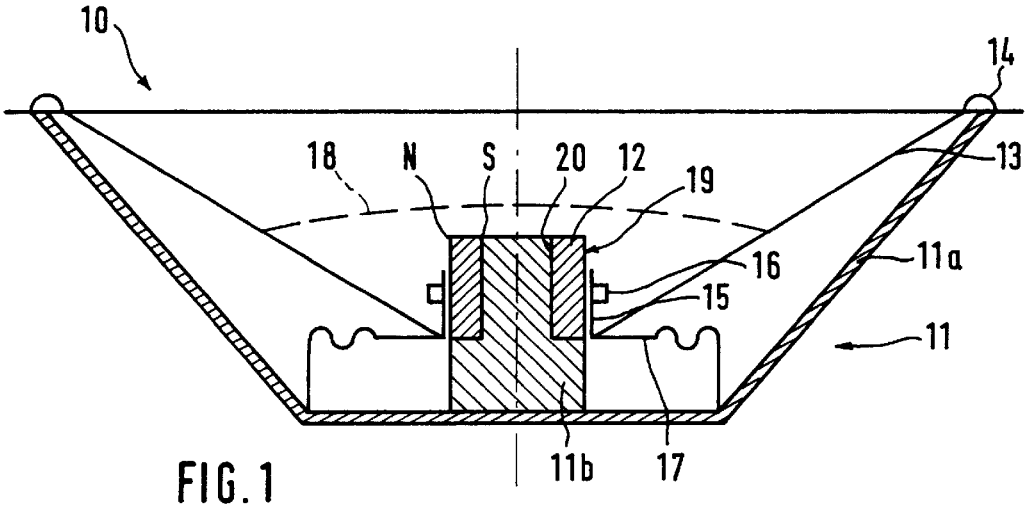
FIG. 1 is a crosscut through a loudspeaker.

The invention will now be explained in greater detail by means of the figures. FIG. 1 illustrates a crosscut through a loudspeaker (10). Essentially this loudspeaker (10) comprises a receiving part (11), a permanent magnet (12) and a diaphragm (13). In the present configuration example the receiving part (11) comprises a loudspeaker basket (11*a*) and a mandrel (11*b*). Polycarbonate was used as the material for the parts (11*a* and 11*b*). A restriction to this material is not required. Another not illustrated example can use other materials such as ABS or metals, for example aluminum, insofar as these materials have paramagnetic or diamagnetic properties. In that case it is essential that at least the mandrel (11*b*), thus the part which is in direct bodily contact with the permanent magnet (12), is made of a paramagnetic or diamagnetic material so that the direct contact does not weaken the field which emanates from the permanent magnet (12). Combinations of the invention containing a mandrel (11*b*) made of a paramagnetic or diamagnetic material and a loudspeaker basket (11*a*) made of a ferromagnetic material, are not excluded.

Figure 4:
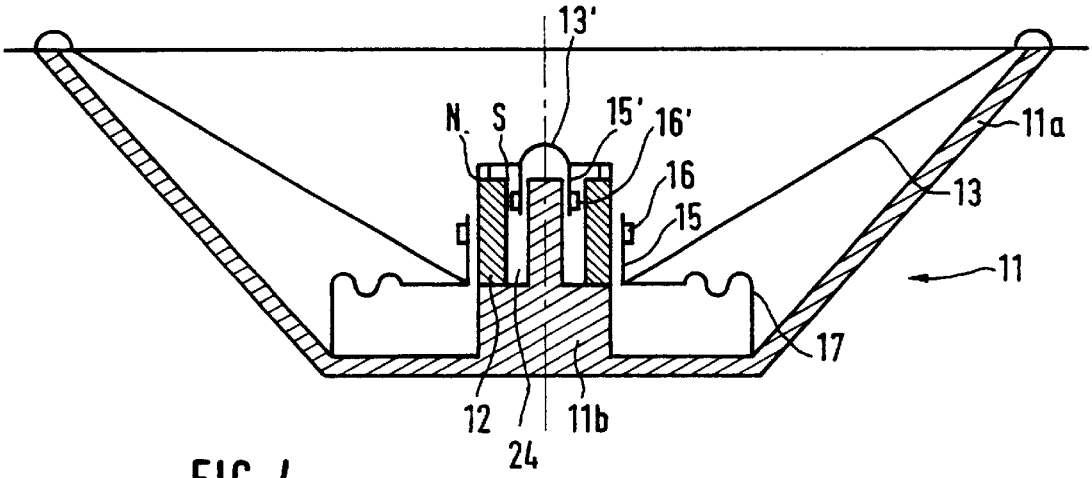
FIG. 4 is another illustration of FIG. 1.

As can easily be seen however, combinations of the parts (11*a*, 11*b*) made of paramagnetic or diamagnetic materials represent the most advantageous configuration. Aside from the neutral effect of such combinations on the stray field of the permanent magnet (12), the manufacture of such combinations is also very cost-effective. The latter applies in particular when the receiving part (11) is made in one piece. Such a one-piece construction of a receiving part (11) is illustrated in FIG. 4.

The mandrel (11*b*) illustrated in FIG. 1 is circular, while the end of the mandrel (11*b*) which faces away from the basket (11*a*) has a smaller diameter than the end that is closer to the basket (11*a*). This configuration of the mandrel (11*b*) serves to receive the circular permanent magnet (12) in a closely fitting manner. For the sake of completeness alone it should be pointed out that the mandrel (11*b*) need not necessarily fill out the internal diameter of the permanent magnet (12) entirely or partly. An assembly wherein the mandrel (11*b*) does not completely fill out the internal diameter of the permanent magnet (12) is illustrated in FIG. 4.

A conical diaphragm (13) is inserted into the basket (11*a*) illustrated in FIG. 1. The upper end of the diaphragm (13) is connected to the basket (11*a*) by means of a bead. The lower end of the diaphragm (13) contains a voice coil support (15) which protrudes into the space surrounded by the diaphragm (13). The voice coil (16) is wound around the outer jacket of the voice coil support (15). Although this voice coil (16) arrangement on the outer jacket of the voice coil support (15) is advantageous from the manufacturing point of view, a better utilization of the stray flux may require placing the voice coil (16) on the inner jacket of the voice coil support (15), (the latter is not shown in FIG. 1).

Furthermore a centering diaphragm (spider) (17) is present, which is connected to the basket (11*a*) and to the diaphragm (13) and centers the voice coil (16) with respect to the longitudinal axis of the magnet system or of the loudspeaker (10).

The mandrel (11*b*), the permanent magnet (12) and the voice coil (16) can additionally be covered by a dust cover (18). In conventional loudspeakers (10) this dust cover (18) has the task of protecting the narrow ring gap against the accumulation of particles. This task is also fulfilled by the dust cover (18) of the system of the invention, even though in systems of the invention which utilize the stray flux, the distance between the voice coil (16) and the permanent magnet (12) is not so critical, therefore the accumulating particles have a rather subordinate significance when no dust cover is present.

As already indicated several times, the voice coil (16) through which current flows is driven by the stray field generated by a radially magnetized permanent magnet (12). For that reason the north pole (N) in the configuration example of FIG. 1 is located on the outer jacket surface (19) and the south pole (S) is located on the inner jacket surface (20) of the permanent magnet (12).

As can easily be seen, the induction from radially magnetized permanent magnets (12) is constant along the jacket surfaces (19/20), so that the voice coil (16) moves in a homogeneous magnetic field along its entire deflection path, which in the final analysis leads to a very linear operation of the loudspeaker (10).

Figure 2:
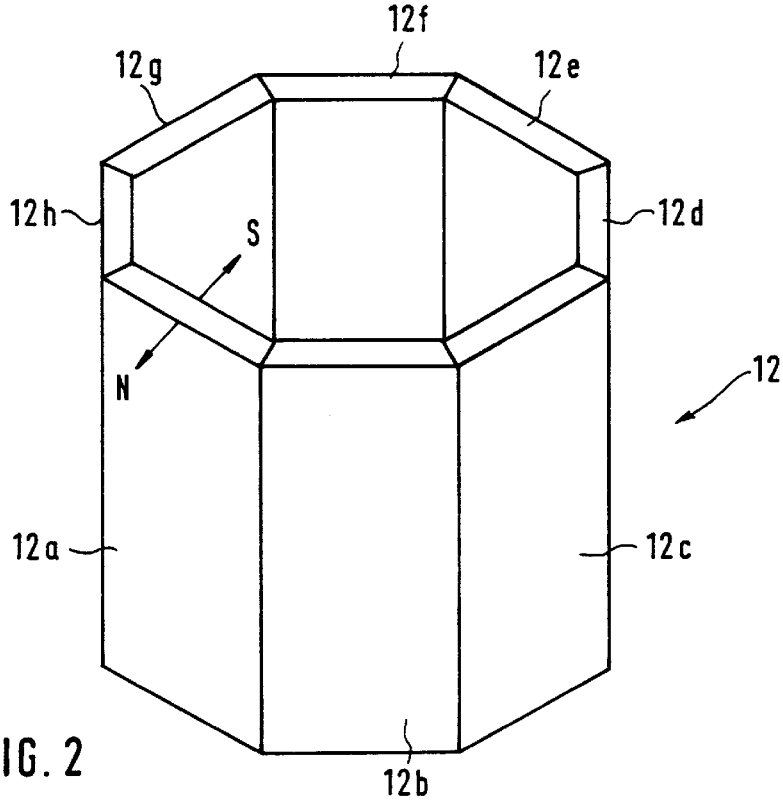
FIG. 2 is a perspective illustration of a permanent magnet.

Nor is the construction of permanent magnets (12) limited to the one-piece circular form. FIG. 2 illustrates a permanent magnet (12) has an octagonal shape which is made of linked permanent magnet segments (12*a–h*). Each of these segments is also radially magnetized as indicated on segment (12*a*). The use of segmented permanent magnets (12) has the advantage that plate material can be used, which is easier to magnetize than circular permanent magnets (12). The octagonal shape of the permanent magnet (12) illustrated in FIG. 2 is only an example.

In another not illustrated configuration example the permanent magnet (12) can also be cube-shaped by linking only four segments.

Figure 3:
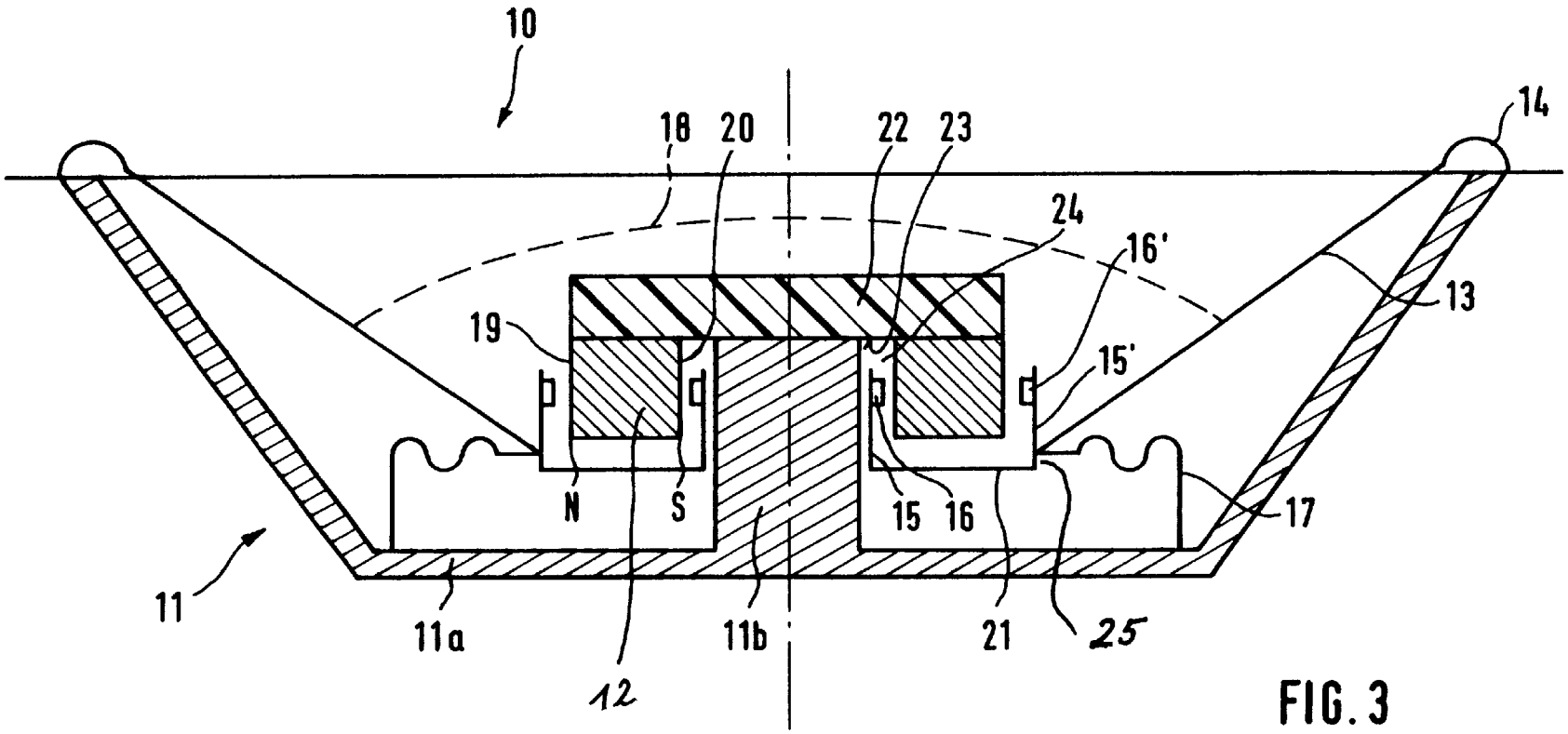
FIG. 3 is another illustration of FIG. 1.

FIG. 3 illustrates a loudspeaker (10) that deviates from the configuration in FIG. 1 by having two voice coil supports (15 and 15'). These two voice coil supports (15, 15') are linked by a circular disk (21) at a reciprocal distance. In addition, each of the two voice coil supports (15, 15') is equipped with a voice coil (16, 16').

On the end that faces away from the basket (11*a*), the mandrel (11*b*) has a disk (22) which is also made of a paramagnetic or diamagnetic material. The underside of the disk (22) is connected to a radially magnetized permanent magnet ring (12). For the sake of completeness alone it should be pointed out that the disk (22) can also be made of a ferromagnetic material, although the selection of such a material would tend to produce a somewhat lower efficiency.

Since the inside diameter of the ring-shaped permanent magnet (12) is larger than the outside diameter of the mandrel (11*b*), and both parts are constructed coaxial with each other, an air gap (24) is formed. The voice coil support (15) which is connected to the coil (16) dips into this air gap (24), while the voice coil (16') arranged on the voice coil support (15') surrounds the outer jacket surface (19) of the permanent magnet (12) at a distance.

Since both coils (16, 16') are wound in the same direction and the current therefore flows in the same direction in both coils (16, 16'), the use of the stray flux from the configuration in FIG. 3 is considerably better for driving the diaphragm (13) than from the configuration in FIG. 1. These conditions can also be achieved with coils (16, 16') having windings that run in opposite directions, if both coils (16, 16') are poled inversely to each other with respect to a (not illustrated) source of tone signals.

For the sake of completeness alone it should be pointed out that when the loudspeakers (10) illustrated in FIGS. 1 and 3 are manufactured, the devices which are used to manufacture the arrangements according to DE-A-4113017 can also be used here without much of a changeover. Particularly the centering sleeves normally used to align and attach the diaphragm (13) in the basket (11*a*), which are inserted between the pole body (mandrel 11*b*) and permanent magnet (12) and the voice coil support (15) during the manufacture of loudspeakers (10), can also be used for the arrangements of the invention.

However the configuration with the two voice coils (16, 16') according to FIG. 3 is not limited to driving only one diaphragm (13). Rather the stray flux of the radially magnetized permanent magnet (12) can also be used to drive different diaphragms (13, 13'). These conditions are illustrated in FIG. 4. In that case, and deviating from the illustration in FIG. 1, the permanent magnet (12) is placed on the mandrel (11*b*). An air gap (24) exists between the inner jacket surface (20) of the radially magnetized permanent magnet ring (12) and the mandrel (11*b*), and a voice coil support (15') with a voice coil (16') wound around it dips into this air gap. The upper end of the voice coil support (15') is equipped with a spherical-shape diaphragm (13'). The outer edge of the spherical diaphragm (13') is connected to the upper end of permanent magnet (12).

If a tone signal from a sound source is applied to this voice coil (16'), the diaphragm (13') can be used to radiate high-frequency sound signals for example, while the diaphragm (13) is used to radiate mid-frequency sound signals for example. To obtain equal phases in the partial tone frequencies radiated by the two diaphragms (13, 13'), the two voice coils (16, 16') in this configuration example must be poled inversely with respect to the sound source when both coils (16, 16') have the same winding direction, because of manufacturing reasons for example.

Figure 5:
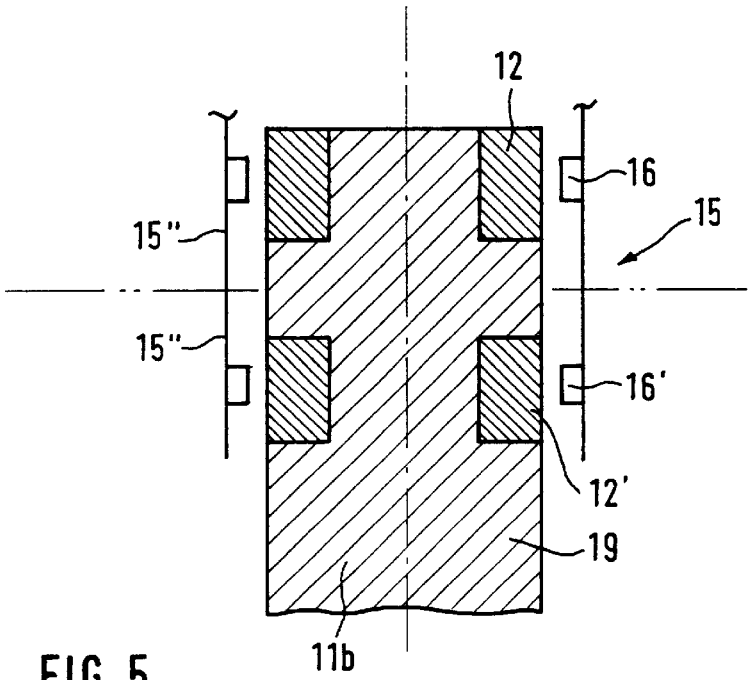
FIG. 5 is a crosscut through a permanent magnet.

FIG. 5 illustrates a mandrel-permanent magnet combination which is a modification of the configuration in FIG. 1. In this case two permanent magnets (12, 12') with reciprocal axial spaces are provided on the mandrel (11*b*). Each of these permanent magnets (12, 12') is magnetized radially, and equal poles of the two permanent magnets (12, 12') point in the same direction. A voice coil support (16) is installed next to the outer jacket surfaces (19) of both permanent magnets (12, 12'), and two voice coils (16, 16') containing reciprocal axial spaces as well are attached thereto. Such an arrangement must be selected when the stray flux of one permanent magnet (12) alone is not sufficient to drive a diaphragm (13). If both coils (16, 16') are used to drive only one diaphragm (13), the current must flow in the same direction in both voice coils (16, 16').

The double dot lines cutting through the voice coil support (15) indicate that the arrangement illustrated in FIG. 5 can also be used to drive different diaphragms (13) if both voice coils (16, 16') are not arranged on a common voice coil support (15), but have autonomous voice coil supports (15").

Nor is it necessary for the mandrel (11*b*) according to FIG. 5 to completely fill the inside diameter of both permanent magnets (12, 12'). The mandrel (11*b*) illustrated in FIG. 5 can rather be modified in accordance with the configurations in FIGS. 3 and 4.

For the sake of completeness it should be pointed out that a mandrel-permanent magnet combination illustrated in FIGS. 1 and 5 can be built very advantageously by placing the permanent magnet or magnets (12, 12') into an injection mold, so that the linking of the permanent magnets (12, 12') can take place simultaneously with the formation of the mandrel (11*b*) or the receiving part (11) which comprises the mandrel (11*b*) and the basket (11*a*).

Figure 6:
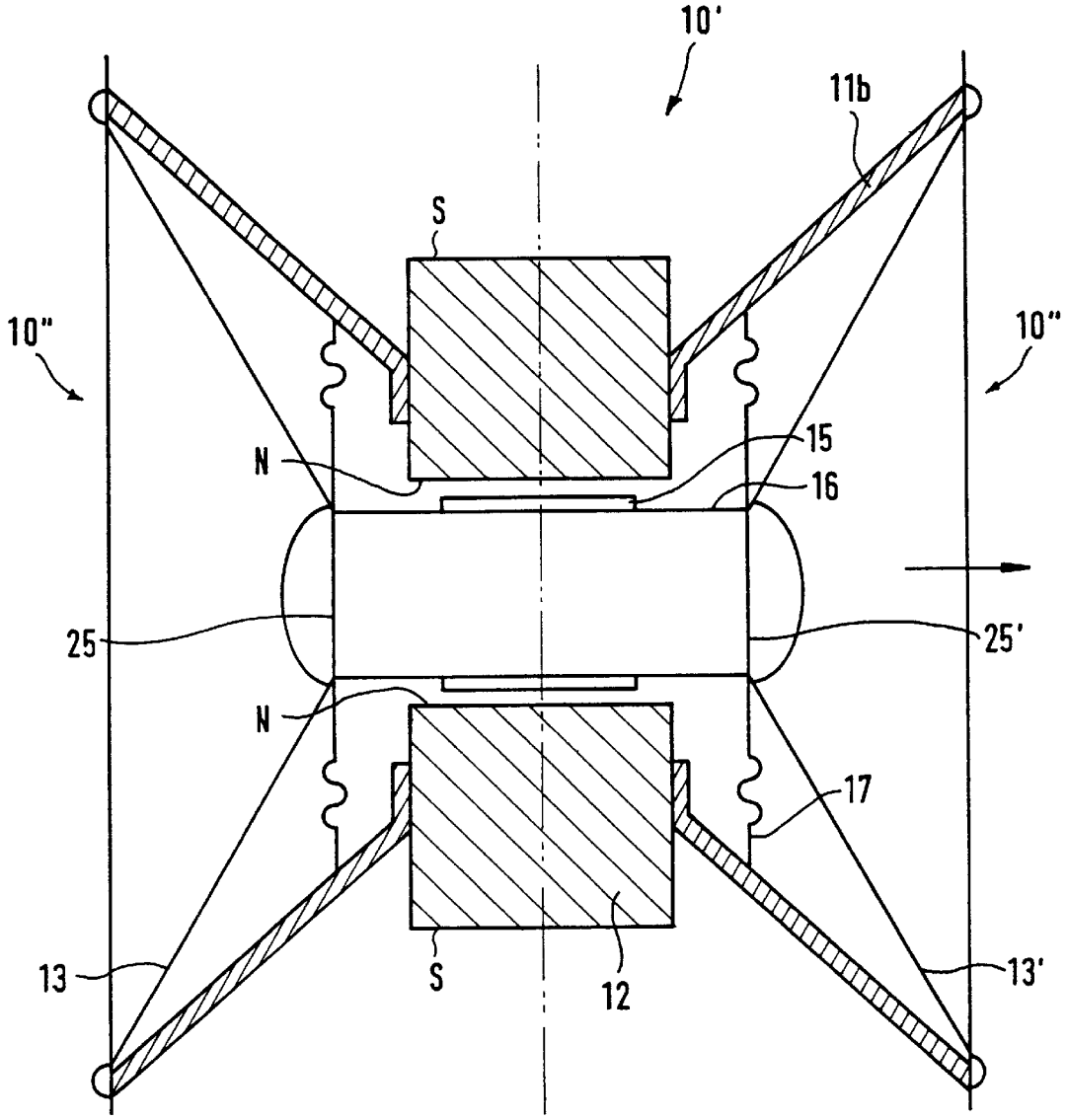
FIG. 6 is another illustration of FIG. 1.

FIG. 6 illustrates a dipole radiator (10') which has a separate loudspeaker (10") on the left and the right side of the double dot line. Each of these loudspeakers (10") corresponds essentially to a loudspeaker shown in DE-A-4113017 (FIG. 1). However the magnet system in FIG. 6 deviates therefrom. It is characterized in that it consists of a radially magnetized permanent magnet (12). In that case the first end (25) of the voice coil support (15) is connected to a diaphragm (13), and the second end (25') of the voice coil support (15) is connected to a different diaphragm (13'). If the voice coil (16) which is connected to the voice coil support (15) receives a tone signal, the voice coil (16) moves and with it and via the voice coil support (15), each of the two diaphragms (13, 13') moves in the direction of the arrow. This means that an air compression takes place on the diaphragm (13') while an air rarefaction takes place on the diaphragm (13). But since both diaphragms (13, 13') are coupled to the common voice coil support (15), the resistances that exist for example on the diaphragm (13') and affect the free swing of this diaphragm (13') also affect the swing of diaphragm (13), so that the latter develops a swing behavior which is identical to that of diaphragm (13'). The result is that both diaphragms (13, 13') generate identical reproduction frequencies, which has considerable significance for the production of a diffuse sound field.

In conclusion it should be pointed out that the permanent magnet rings (12, 12') illustrated in FIG. 5 can also be used in another not illustrated configuration example with an arrangement according to FIG. 6. An arrangement according to FIG. 6 can also be modified so that the two diaphragms (13, 13') illustrated in FIG. 6 can be driven by two voice coils (16, 16') arranged at a lateral distance from the inner and outer jacket surface (19, 20) of the permanent magnet (12), as illustrated in FIG. 4.

What is claimed is:

1. A loudspeaker comprising:

a receiving part (11) having a mandrel (11*b*) and a basket (11*a*) a voice coil (16) having an inner periphery and an outer periphery;

a diaphragm (13) attached to the basket (11*a*) and the voice coil (16); and at least one permanent magnet ring (12) made of a magnetic ring material and disposed inside the inner periphery of the voice coil for driving the voice coil, wherein the permanent magnetic ring is magnetized crosswise to the longitudinal axis of the loudspeaker such that a first magnetic pole of the ring material is always closer than a second opposite magnetic pole of the magnetic ring material with respect to the longitudinal axis of the loudspeaker and such that only one of said at least one permanent magnet ring (12) is positioned in any given plane perpendicular to said longitudinal axis of the loudspeaker, whereby magnetic field lines within the ring material are substantially perpendicular to the longitudinal axis of the loudspeaker, wherein the mandrel (11*b*) is dimensioned for supporting the magnetic ring (12) and arranged such that the mandrel is substantially adjacent only to the inner periphery of the voice coil so that magnetic field lines from the second magnetic pole that pass through the inner periphery and outer periphery of the voice coil form loops that return to the first magnetic pole of the magnetic ring, wherein the portion of substantially all said loops, which extends radially beyond the outer periphery of the voice coil, only passes through air, and possibly the diaphragm, prior to returning to the first magnetic pole of the magnetic ring.

2. A loudspeaker as claimed in claim 1, characterized in that the receiving part which has direct contact to the permanent magnet ring is a loudspeaker basket (11*a*).

3. A loudspeaker as claimed in claim 1, characterized in that the receiving part which has direct contact to the permanent magnet ring is a receiving mandrel (11*b*).

4. A loudspeaker as claimed in claim 3, characterized in that the receiving mandrel (11*b*) and the loudspeaker basket (11*a*) are made in one piece.

5. A loudspeaker as claimed in claim 4 characterized in that the receiving part which has direct contact to the permanent magnet ring is made of metal or a metal alloy.

6. A loudspeaker as claimed in claim 1 with at least one permanent magnet ring (12) made of a ring material which is magnetized crosswise to the longitudinal axis of the loudspeaker such that a first magnetic pole of the ring material is always closer than a second opposite magnetic pole to the voice coil and such that only one of said at least one permanent magnet ring (12) is positioned in any given plane perpendicular to said longitudinal axis of the loudspeaker, whereby magnetic lines within the ring material are substantially perpendicular to the longitudinal axis of the loudspeaker, and with at least one receiving part which supports the permanent magnet ring (12), or is connected thereto, characterized in that at least the receiving part which has direct contact to the permanent magnet ring is a receiving mandrel made exclusively of metal or a metal alloy having paramagnetic or diamagnetic properties, forming a one-piece circle or a number of laterally permanent magnetic segments (12*a–h*), which in linked condition form a hollow profile, and that a first voice coil (16) is present which is located at a radial distance from one of the jacket surface faces (19;20) of the permanent magnet ring (12), and wherein the receiving mandrel and the loudspeaker basket are made in one piece.

7. A loudspeaker with at least one permanent magnet ring (12) made of a ring material which is magnetized crosswise to the longitudinal axis of the loudspeaker such that a first magnetic pole of the ring material is always closer than a second opposite magnetic pole to the voice coil and such that only one of said at least one permanent magnet ring (12) is positioned in any given plane perpendicular to said longitudinal axis of the loudspeaker, whereby magnetic lines within the ring material are substantially perpendicular to the longitudinal axis of the loudspeaker, and with at least one receiving part which supports the permanent magnet ring (12), or is connected thereto, characterized in that at least the receiving part which has direct contact to the permanent magnet ring is a receiving mandrel made exclusively of metal or a metal alloy having paramagnetic or diamagnetic properties, forming a one-piece circle or a number of laterally permanent magnetic segments (12*a–h*), which in linked condition form a hollow profile, and that a first voice coil (16) is present which is located at a radial distance from one of the jacket surface faces (19;20) of the permanent magnet ring (12), and wherein the receiving mandrel and the loudspeaker basket are made in one piece, said loudspeaker further characterized by a second voice coil (16'), which is located at a radial distance from the other jacket surface of the permanent magnetic ring.

8. A loudspeaker as claimed in claim 7, characterized in that another permanent magnet ring (12') is present in addition to the respective permanent magnet ring (12), that the two permanent magnet rings (12, 12') are arranged at a reciprocal axial distance from each other with reference to the longitudinal axis of the loudspeaker, and that the voice coils (16, 16') which are radially arranged on the respective jacket surface (19, 20) of the two permanent magnet rings (12, 12'), are rigidly linked to each other.

9. A loudspeaker as claimed in claim 8, characterized by a diaphragm (13, 13'), and further characterized in that each voice coil (16, 16') is arranged on a voice coil support (15, 15'), wherein the voice coil support (15) is a common voice coil support (15) for the two voice coils (16, 16'), that each voice coil support (15, 15') has a first end (25) and a second end (25'), and that the first end (25) at least is connected to the diaphragm (13, 13').

10. A loudspeaker as claimed in claim 9, characterized by a second diaphragm (13'), and further characterized in that the first end (25) is connected to the first diaphragm and the second end (25') is connected to the second diaphragm, and that both diaphragms (13, 13') are identical.

11. A loudspeaker as claimed in claim 3, characterized in that the receiving part which has direct contact to the permanent magnet ring is made of metal or a metal alloy.

12. A loudspeaker as claimed in claim 1, characterized in that the receiving part which has direct contact to the permanent magnet ring is made of metal or a metal alloy.

13. A loudspeaker as claimed in claim 1 with at least one permanent magnet ring (12) made of a ring material, which is magnetized crosswise to the longitudinal axis of the loudspeaker such that a first magnetic pole of the magnet ring is always closer than a second opposite magnetic pole to the voice coil (16) and such that only one of said at least one permanent magnet ring (12) is positioned in any given plane perpendicular to said longitudinal axis of the loudspeaker, whereby magnetic lines within the ring material are substantially perpendicular to the longitudinal axis of the loudspeaker, and with at least one receiving part which supports the permanent magnet ring (12), or is connected thereto, characterized in that at least the receiving part, which has direct contact to the permanent magnet ring, is made exclusively of a material that has paramagnetic or diamagnetic properties, wherein the respective permanent magnet ring is a one-piece circle or a number of laterally permanent magnet segments (12*a–h*), which in the linked condition form a hollow profile, and that a first voice coil (16) is present which is located at a radial distance from one of the jacket surfaces (19;20) of the permanent magnet ring (12).

14. A loudspeaker with at least one permanent magnet ring (12) made of a ring material, which is magnetized crosswise to the longitudinal axis of the loudspeaker such that a first magnetic pole of the magnet ring is always closer than a second opposite magnetic pole to the voice coil (16) and such that only one of said at least one permanent magnet ring (12) is positioned in any given plane perpendicular to said longitudinal axis of the loudspeaker, whereby magnetic lines within the ring material are substantially perpendicular to the longitudinal axis of the loudspeaker, and with at least one receiving part which supports the permanent magnet ring (12), or is connected thereto, characterized in that at least the receiving part, which has direct contact to the permanent magnet ring, is made exclusively of a material that has paramagnetic or diamagnetic properties, wherein the respective permanent magnet ring is a one-piece circle or a number of laterally permanent magnet segments (12*a–h*), which in the linked condition form a hollow profile, and that a first voice coil (16) is present which is located at a radial distance from one of the jacket surfaces (19;20) of the permanent magnet ring (12), said loudspeaker further characterized by a second voice coil (16'), which is located at a radial distance from the other jacket surface of the permanent magnetic ring (12).

15. A loudspeaker as claimed in claim 14, characterized in that another permanent magnet ring (12') is present in addition to the respective permanent magnet ring (12'), that the two permanent rings (12, 12') are arranged at a reciprocal axial distance from each other with reference to the longitudinal axis of the loudspeaker, and that the voice coils (16, 16') which are radially arranged on the respective jacket surface (19, 20) of the two permanent magnet rings (12, 12'), are rigidly linked to each other.

16. A loudspeaker as claimed in claim 15, characterized by a diaphragm (13, 13'), and further characterized in that each voice coil (16, 16') is arranged on a voice coil support (15, 15'), wherein the voice coil support (15) is a common voice coil support (15) for the two voice coils (16, 16'), that each voice coil support (15, 15') has a first end (25) and a second end (25'), and that the first end (25) at least is connected to the diaphragm (13, 13').

17. A loudspeaker as claimed in claim 16, characterized by a second diaphragm (13'), and further characterized in that the first end (25) is connected to the first diaphragm and the second end (25') is connected to the second diaphragm, and that both diaphragms (13, 13') are identical.

18. The loudspeaker of claim 1, wherein the permanent magnetic ring (12) is disposed adjacent to the mandrel (11*b*) leaving a gap (14) therebetween, said loudspeaker further comprising a further voice coil (16) disposed in the gap (14) between the permanent magnetic ring (12) and the mandrel.

* * * * *

UNITED STATES PATENT AND TRADEMARK OFFICE

CERTIFICATE OF CORRECTION

PATENT NO. : 6,359,997 B2
DATED : March 19, 2002
INVENTOR(S) : Geisenberger et al.

It is certified that error appears in the above-identified patent and that said Letters Patent is hereby corrected as shown below:

Title page,
Item [56], U.S. PATENT DOCUMENTS,
"Shim et al." should be -- Shimakawa et al. --.

Item [56], FOREIGN PATENT DOCUMENTS, add foreign documents as listed:

| | | | |
|---|---|---|---|
| -- | 4215519 C1 | 9/1993 | DE...H04R 9/06 |
| | 3110547 A1 | 3/1982 | DE...H04R 9/06 |
| | 3611120 A1 | 10/1987 | DE...H04R 9/06 |
| | 3110278 A1 | 9/1982 | DE...H04R 9/06 -- |

Signed and Sealed this

Eighth Day of October, 2002

*Attest:*

*Attesting Officer*

JAMES E. ROGAN
*Director of the United States Patent and Trademark Office*